US011673783B1

(12) United States Patent
Brunk, III

(10) Patent No.: US 11,673,783 B1
(45) Date of Patent: Jun. 13, 2023

(54) SYSTEMS, DEVICES, AND/OR METHODS FOR MANAGING AERIAL WORK

(71) Applicant: Harry Anthony Brunk, III, Singers Glen, VA (US)

(72) Inventor: Harry Anthony Brunk, III, Singers Glen, VA (US)

( * ) Notice: Subject to any disclaimer, the term of this patent is extended or adjusted under 35 U.S.C. 154(b) by 0 days.

(21) Appl. No.: 17/549,521

(22) Filed: Dec. 13, 2021

(51) Int. Cl.
*B66F 11/04* (2006.01)

(52) U.S. Cl.
CPC ..... *B66F 11/046* (2013.01)

(58) Field of Classification Search
CPC ..... B66F 11/00; B66F 11/04; B66F 11/042; B66F 11/044; B66F 11/048; B66F 9/0759; B66F 9/12; B66F 9/125; B66F 9/127
See application file for complete search history.

(56) References Cited

U.S. PATENT DOCUMENTS 2,410,373 A * 10/1946 Westervelt, Jr. ..... B66F 9/061 212/203
3,022,854 A * 2/1962 Eckels ..... B66F 11/044 182/2.4
3,062,504 A * 11/1962 Blanchard ..... B66F 3/44 254/DIG. 2
3,709,322 A * 1/1973 Mitchell ..... B64F 5/10 182/148
4,356,887 A * 11/1982 Fisher ..... B66F 11/042 182/69.5
5,497,851 A * 3/1996 Walcher ..... B66F 9/127 182/148

FOREIGN PATENT DOCUMENTS

DE 4231843 A1 * 3/1994 ..... B25F 1/02

* cited by examiner

*Primary Examiner* — Tyrone V Hall, Jr.
(74) *Attorney, Agent, or Firm* — Dale Jensen, PLC; Dale Jensen

(57) ABSTRACT

Certain exemplary embodiments can provide a system comprising a rotatable aerial platform. The rotatable aerial platform comprises a yoke assembly, an annular base member, an upper frame, a chain drive, and a load supporting deck. The annular base member is coupled to the yoke assembly. The load supporting deck coupled to the upper frame, the load supporting deck constructed to support personnel and materials. The rotatable aerial platform is rotatable and positionable about a vertical axis permitting access to elevated locations.

12 Claims, 8 Drawing Sheets

SYSTEMS, DEVICES, AND/OR METHODS FOR MANAGING AERIAL WORK

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Figure 1:
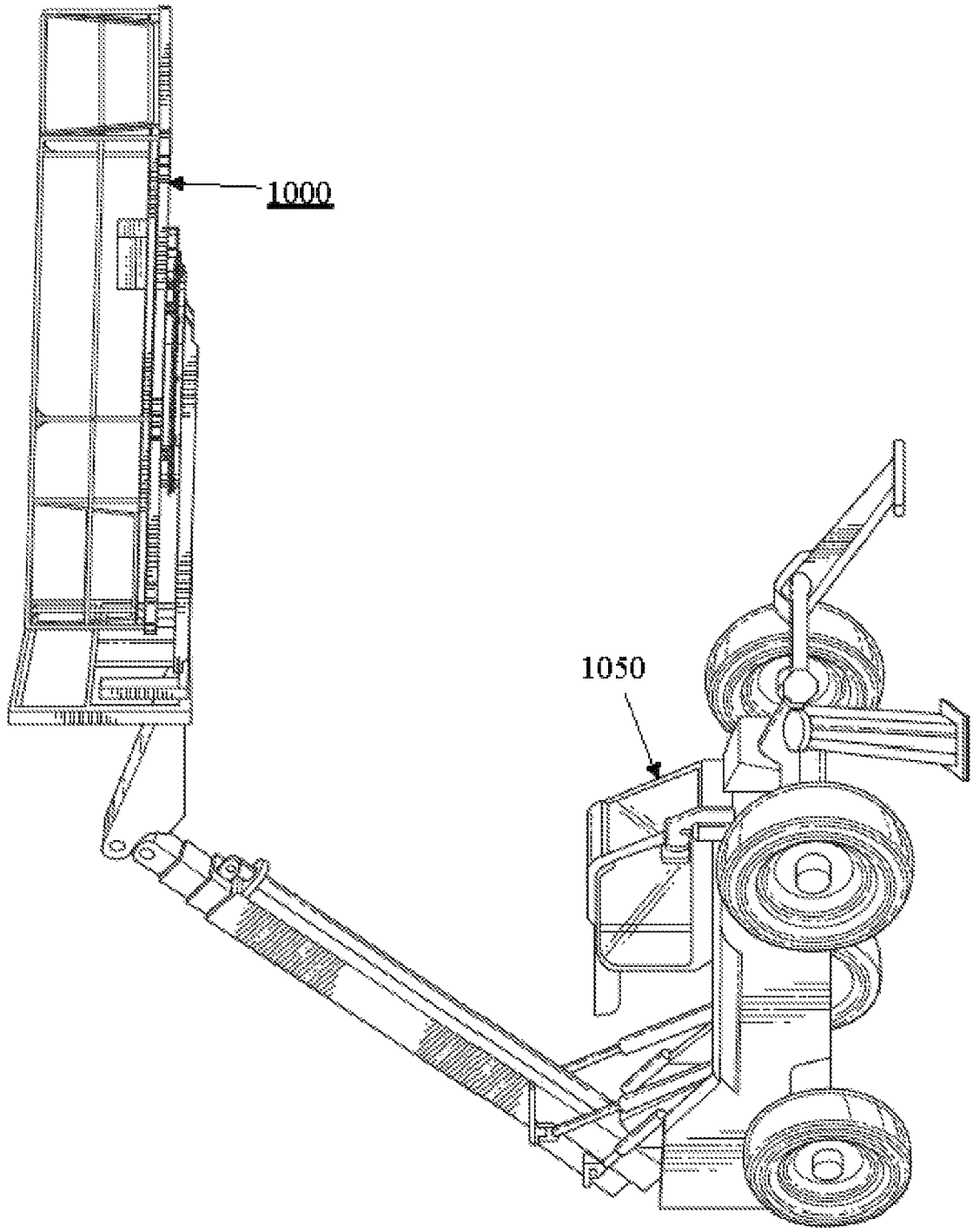
FIG. 1 is a perspective view of an exemplary embodiment of a rotatable aerial platform 1000, which is positioned at an elevated level on a telescopic boom forklift vehicle 1050.

Certain exemplary embodiments can provide a system comprising a rotatable aerial platform. The rotatable aerial platform comprises a yoke assembly, an annular base member, an upper frame, a chain drive, and a load supporting deck. The annular base member is coupled to the yoke assembly. The load supporting deck coupled to the upper frame, the load supporting deck constructed to support personnel and materials. The rotatable aerial platform is rotatable and positionable about a vertical axis permitting access to elevated locations.

Certain exemplary embodiments provide a machine that is a rotating rectangular work stage/platform enclosed by a safety railing and gate system with dimensions adequate for handling personnel, equipment, and/or materials/supplies. The platform comprises a circular supporting framework mounted on steel receiving channels constructed to accept and lock onto the forks of a telehandler or other forklift truck. The receiving channels are welded to the circular carriage base and central pivot yoke. The platform is coupled to and rotates on the carriage base and yoke. The platform is coupled to the base and yoke by rollers and a central axle/pin. The rotation of the platform is actuated by an electrical motor, hydraulic motor, manual crank, hand wheel, or drill-driven shaft, which operates a chain drive system or cog-to-cog gear drive system. Electric and hydraulic motor powered systems are controlled by forward and reverse switching mounted on a user interface that comprises a pedestal and dashboard. The platform can be rotated continuously in either direction for the purpose of positioning workers, equipment, and/or materials and supplies to perform tasks at heights above the ground otherwise requiring scaffolding and ladders. The platform's safety devices comprise an OSHA compliant railing and gate system with personnel fall protection/harness connectors and baseboard, foot pedal-actuated rotation lock/brake, and fork lock/retainer pins. The rotation lock/brake release pedal is part of a control pedestal, which can be located just outside of the railing-enclosed standing area of the platform. The control pedestal is a fixedly coupled part of the rotating platform/ standing area portion of the machine. The rotation lock/brake release pedal is coupled to a lever, which raises a spring-loaded deadbolt pin coupled to the rotating platform part of the machine. The deadbolt pin, when in the inserted/locked position (at all times when not retracted by the operator pressing the foot pedal), rests in an aperture in the vertical surface of the upper ring of the annular base member upon which the support rollers of the platform ride. There are multiple apertures of this type evenly spaced around the circumference of the flange. When the platform operator depresses the safety lock/brake release pedal, the lever coupled to the safety lock/brake release pedal also (while retracting the spring-loaded deadbolt pin) makes a connection to complete an electrical circuit to supply power to a forward/reversing rocker switch mounted on the control pedestal. The rocker switch sends power to a motor. A sprocket is mounted on the shaft of the motor and drives a chain that encircles the lower circumference of the annular base of the support frame on which the standing area/platform rotates. The chain links catch on dogs/pins protruding from the circular rim of the annular base. Energizing the motor runs the sprocket (affixed to the motor shaft) on the chain causing the motor and platform to rotate around the stationary support carriage of the supporting frame, which can be mounted to telehandler or forklift forks. Rocking the switch to the right causes the platform to rotate to the right (clockwise as viewed from above). Rocking the switch to the left rotates the platform to the left (counter-clockwise).

A forklift or telehandler operator trained to operate the lifting machinery can engage a platform machine by inserting forks of a forklift or telehandler into the fork receiving channels of an exemplary platform and then coupling two or more safety locking pins, such as one behind each fork, through holes in receiving channel pin tabs. One or more persons aboard the platform (separate from the operator) can enter/exit, load/unload equipment and materials via a gate located at each end of the platform (the ends being the sides of the rectangular platform with the smaller dimension). Personnel aboard the platform can wear fall protection harnesses. Upon entering the platform, personnel can clip/connect straps for fall-protection harness(s) to connection locations on a safety rail system. The platform can be lifted by the telehandler or forklift to an appropriate working height. The platform can be rotated into a desired position by one of the persons aboard the platform using controls for the platform rotation system. Rotation controls are located on a pedestal fastened to the frame of the platform. In order to rotate the platform, the person operating the rotation system will press down a foot pedal to release the safety rotation lock/brake. The foot pedal actuates a lever, which retracts a spring-loaded safety deadbolt/pin and also completes an electrical connection to power a rotation drive motor (as described infra). While holding the foot pedal in a depressed position, an operator/worker moves a switch mounted on the pedestal to the right or to the left. As the switch is moved to the right or left, the drive motor is energized and will turn a drive sprocket affixed to the motor shaft. Moving the switch to the right energizes the motor to drive the sprocket in a direction that causes the platform to rotate to the right (clockwise as viewed from above the platform). Moving the switch to the left energizes the motor to drive the sprocket in a direction that causes the platform to be rotated to the left (counter-clockwise). The drive sprocket connects with a chain and will run along the chain to cause the platform to rotate around the stationary support framework which is mounted on the forks of the lifting machinery (the telehandler or forklift) as described in the machine description. The platform can be rotated in either direction to achieve desired positioning to perform tasks at hand.

Certain exemplary embodiments provide systems, devices, and/or methods for transporting, lifting, and positioning movable platforms on powered industrial vehicles. Such embodiments elevate and permit work persons to place themselves and materials in any desired position for carrying out desired operations. Certain exemplary embodiments provide a rotatable aerial platform, which can be utilized with forklift trucks.

Powered industrial vehicles such as lift trucks are used to lift and transport materials and personnel. Forklift vehicles are distinguished by an elevator guided to travel up and down on upright guides suitably mounted on the forklift vehicles and provided with horizontal outwardly projecting arms often referred to as "forks" on which a load may be placed for transportation. These vehicles have mechanisms and systems under control of the driver by which an elevator may be raised or lowered.

Forklift vehicles are able to pick up and deposit loads. Certain exemplary embodiments provide a movable platform, (which becomes the primary load), to facilitate placement of secondary loads (i.e. personnel, equipment, and/or materials) in narrow spaces where space for positioning the forklift vehicle might be limited. Ground-level building site spaces adjacent to doorways or constrained areas are more readily accessible utilizing exemplary movable platforms.

During construction of buildings and other structures, it is often helpful to lift workers and materials to elevated levels and positions. A powered industrial truck such as a telescopic boom forklift vehicle intended for lifting and moving loads can comprise a chassis section, a lifting section, and/or a control unit. The lifting section can comprise a boom assembly and a slewing mechanism, the boom assembly can be supported on the chassis section and comprises a telescopic boom, on the working end of which may be fitted forklift arms for receiving a platform. The control unit can comprise a chassis control, which controls the chassis section, and a boom assembly control, which controls the boom assembly. The control unit can be constructed for operation from outside an unmanned telehandler. The chassis section can comprise stands for either of a wheeled or of a tracked telehandler chassis, which stands enable a transfer of the telehandler from one worksite location to another and on which may be supported the lifting section including the boom assembly and the slewing mechanism intending for rotating the same. Telehandlers can comprise telescopic or articulated booms to position aerial deck and platforms at selected elevations. Certain exemplary embodiments facilitate positioning a platform substantially flush to a vertical surface or in close proximity to wall intersections/corners, or within an interior corner of a building or substantially flush with the edge of a roof or vertical wall. Certain exemplary embodiments facilitate improved alignment of elevated platforms.

Certain exemplary embodiments facilitate elevating workers and/or materials, and can be rotated to conform the deck of the platform to a desired position relative to a structure regardless of the position of the lift vehicle or other lifting mechanism.

Certain exemplary embodiments provide a rotatable aerial platform constructed for elevating and supporting a load on forks of a forklift vehicle while such load is being moved or rotated such that a side of the rotatable aerial platform is positionable at an angle within an interior corner or flush up against a surface of a structure.

Certain exemplary embodiments provide a rotatable aerial platform that can be positioned by a worker on the rotatable aerial platform.

Certain exemplary embodiments provide a rotatable aerial platform that can be locked into position by a worker on the platform. Certain exemplary embodiments provide a rotatable aerial platform that is economical and easy to use.

Certain exemplary embodiments provide a rotatable aerial platform that comprises a rotatable upper frame, a load supporting deck, an annular base member and yoke assembly, and forklift arm receiving channels.

In certain exemplary embodiments, arm receiving channels are coupleable to forklift arms, which channels are constructed for use with lifting forks such as forklift vehicles, and heavy machines or telehandlers having telescopic booms.

FIG. 1 is a perspective view of an exemplary embodiment of a rotatable aerial platform 1000, which is positioned at an elevated level on a telescopic boom forklift vehicle 1050.

Figure 2:
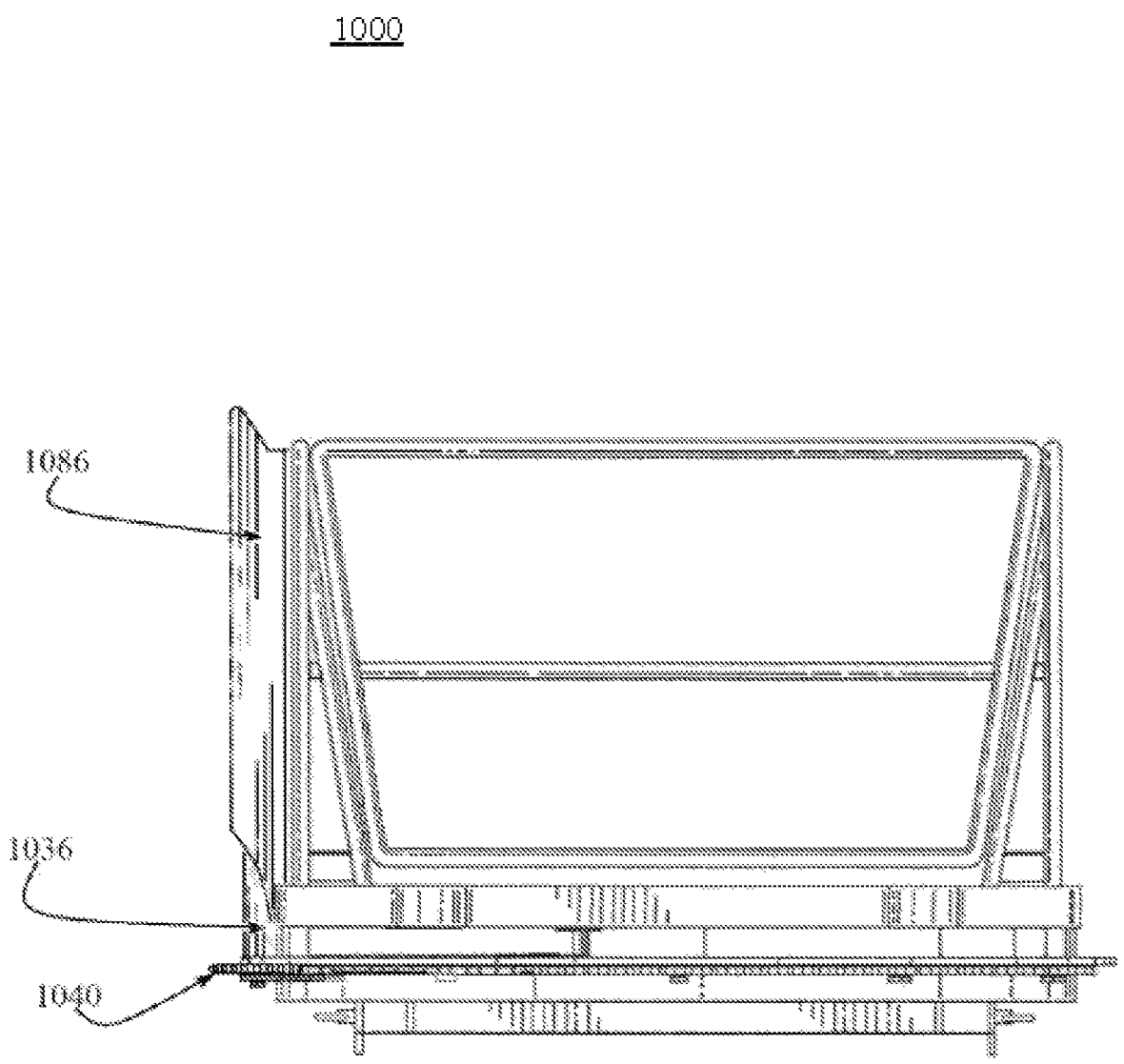
FIG. 2 is a front, proximal view of rotatable aerial platform 1000.

FIG. 2 is a front, proximal view of rotatable aerial platform 1000.

Figure 3:
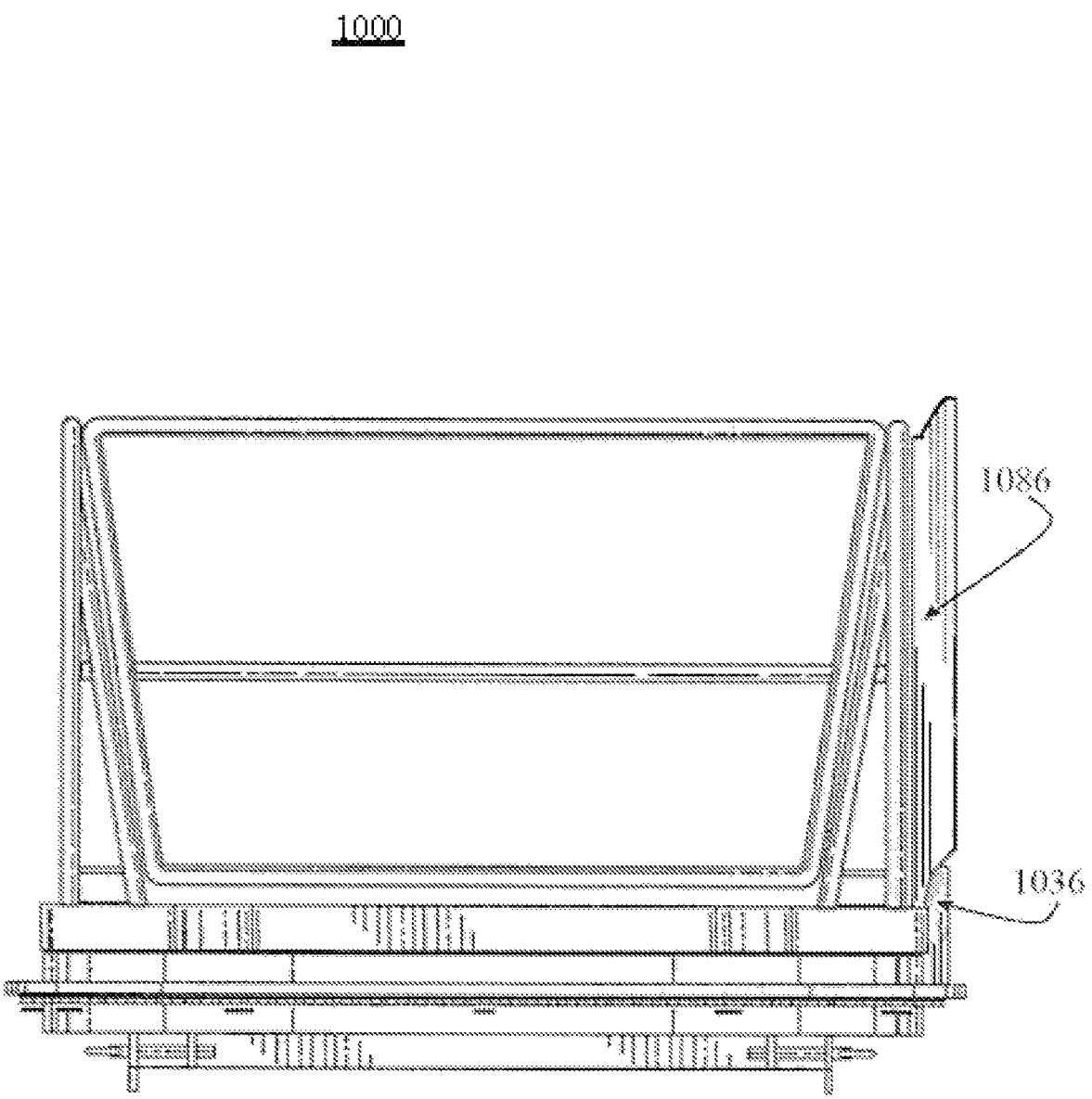
FIG. 3 is a rear, distal view of rotatable aerial platform 1000.

FIG. 3 is a rear, distal view of rotatable aerial platform 1000.

Figure 4:
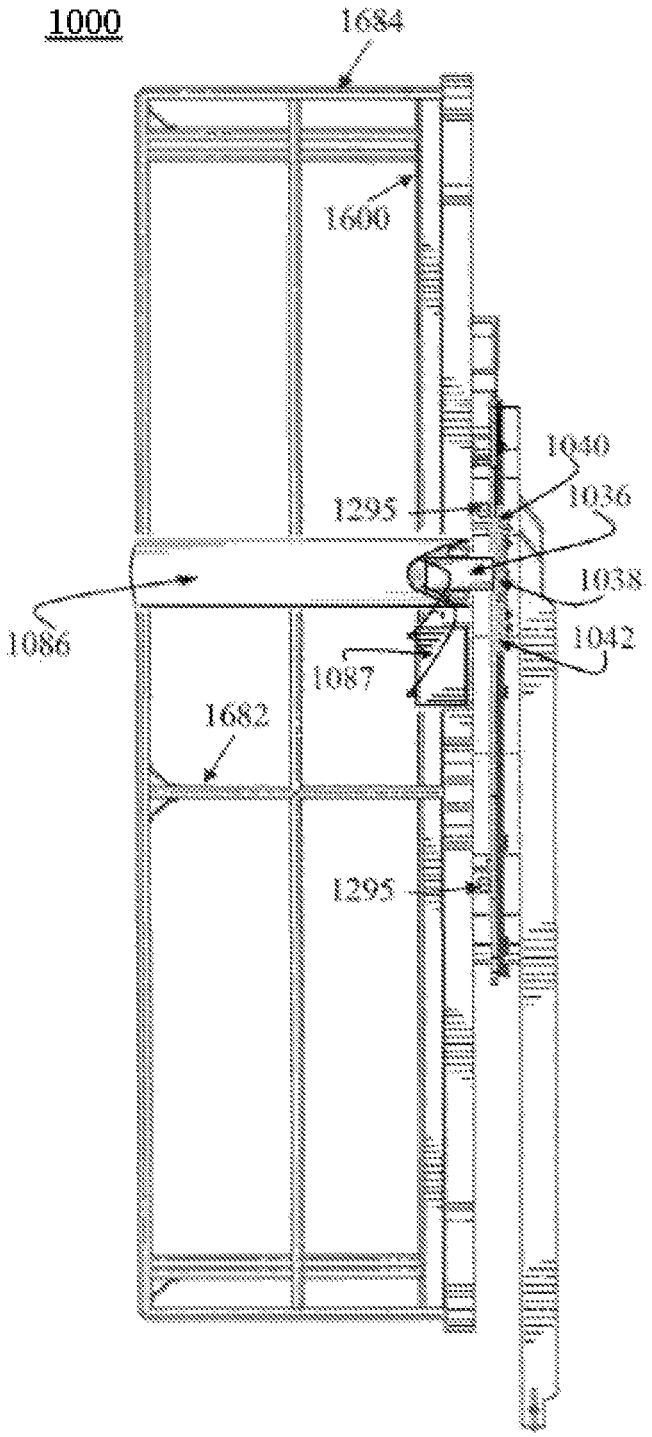
FIG. 4 is a side view of rotatable aerial platform 1000.

FIG. 4 is a side view of rotatable aerial platform 1000.

Figure 5:
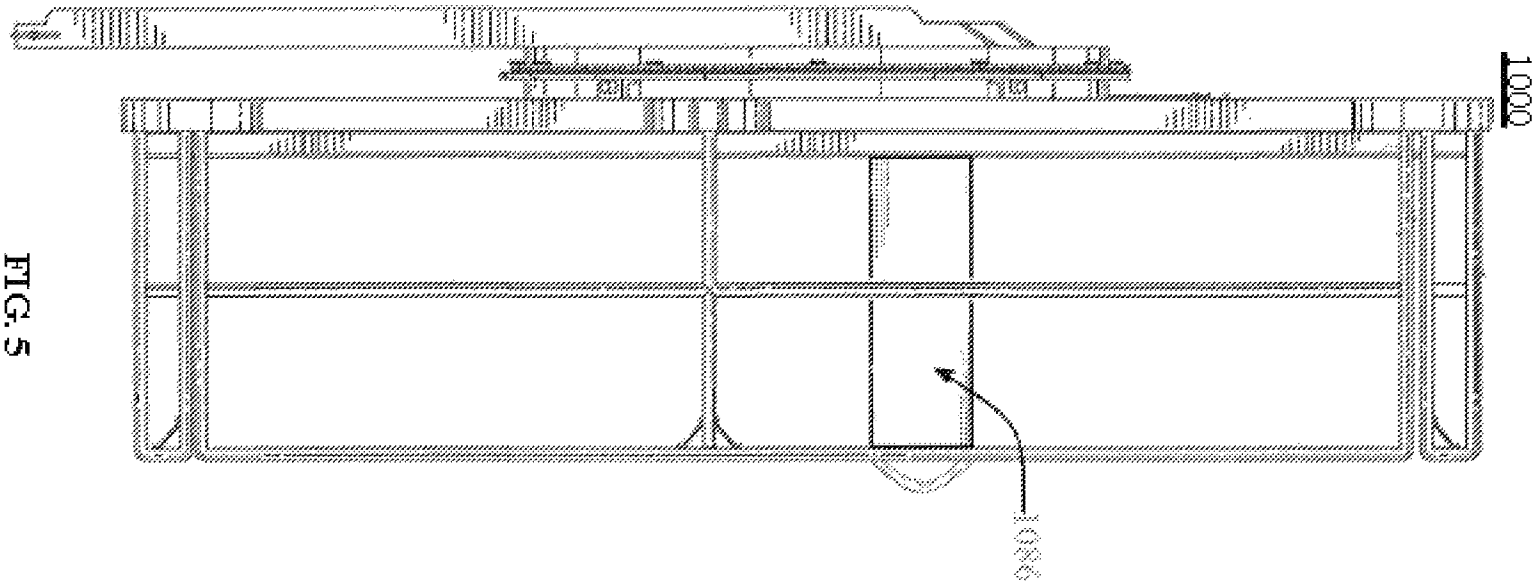
FIG. 5 is an opposite side view of rotatable aerial platform 1000.

FIG. 5 is an opposite side view of rotatable aerial platform 1000.

Figure 6:
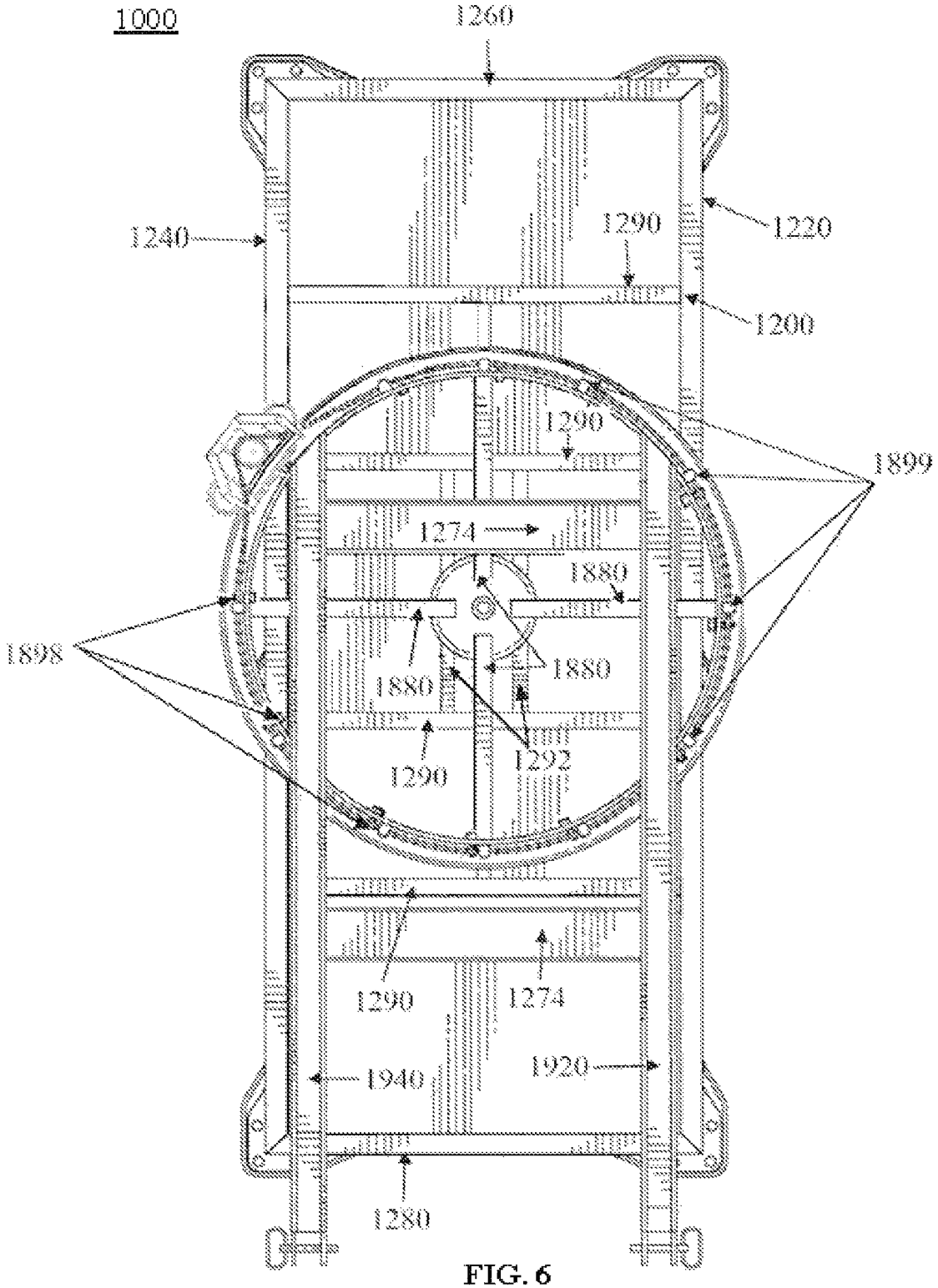
FIG. 6 is a bottom view of rotatable aerial platform 1000.

FIG. 6 is a bottom view of rotatable aerial platform 1000.

Figure 7:
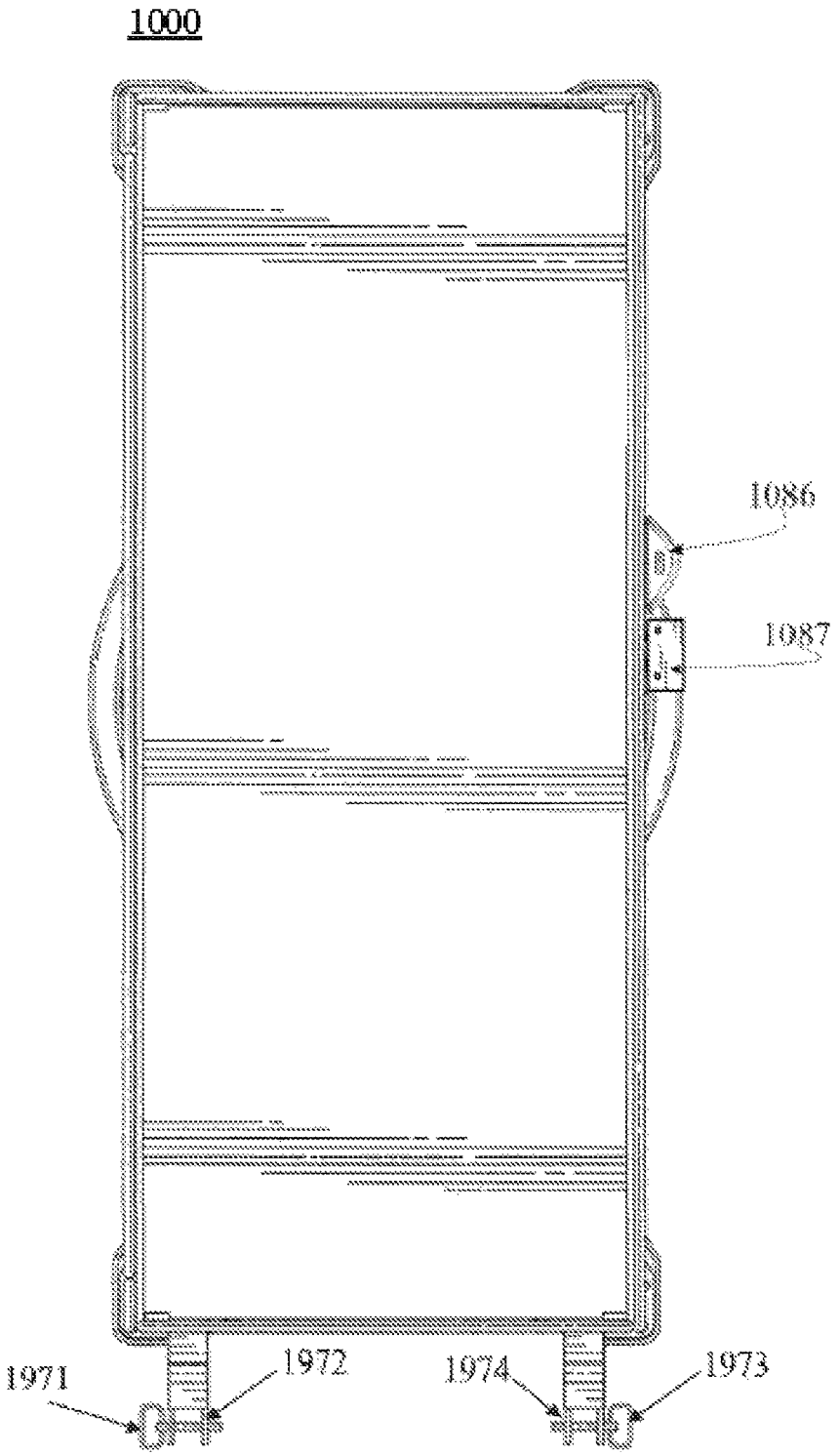
FIG. 7 is a top, plan view of rotatable aerial platform 1000.

FIG. 7 is a top, plan view of rotatable aerial platform 1000.

Figure 8:
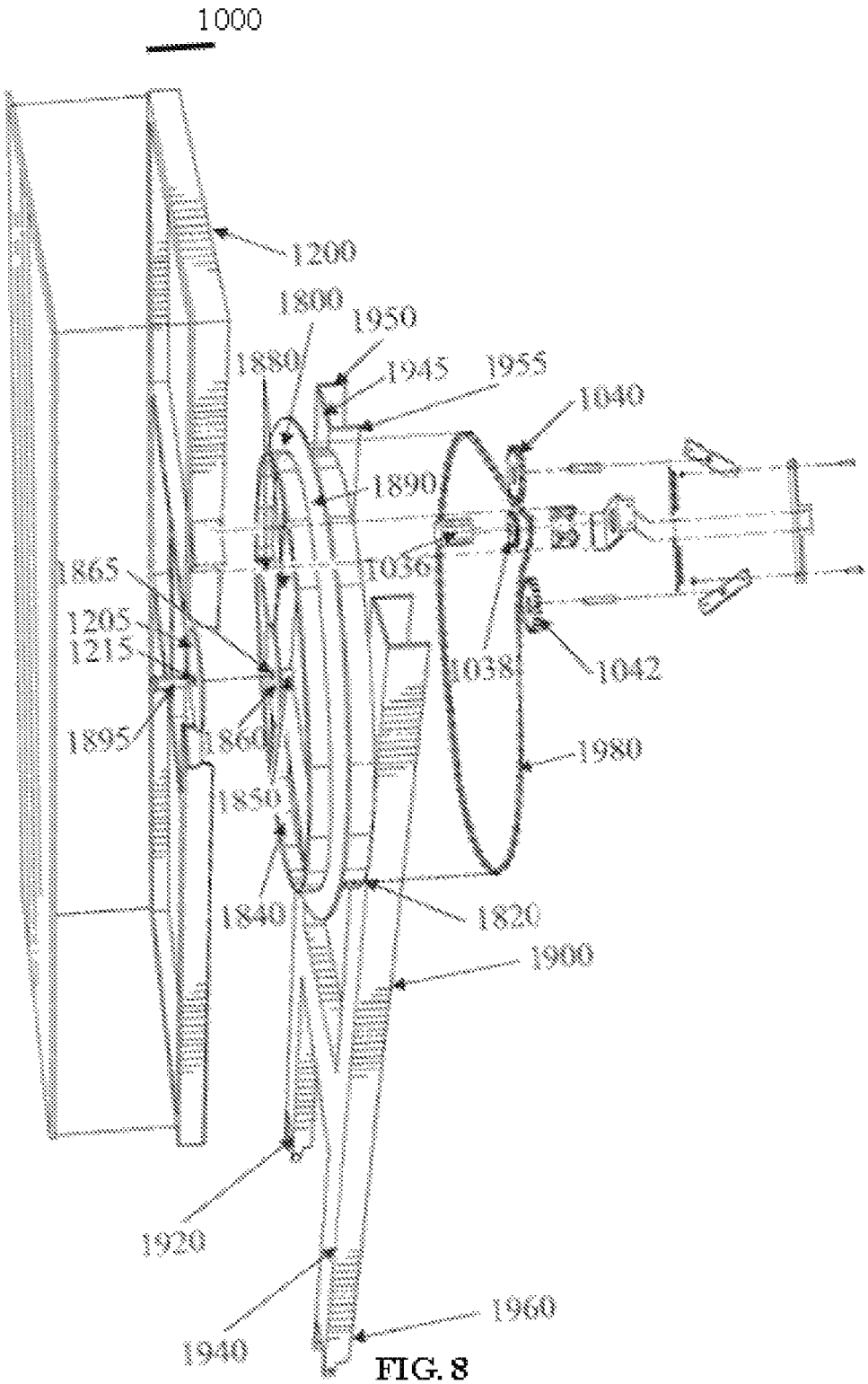
FIG. 8 is an exploded view of rotatable aerial platform 1000.

FIG. 8 is an exploded view of rotatable aerial platform 1000.

FIGS. 1-8 illustrate schematically a rotatable aerial platform constructed for elevating and positioning workers and/or materials.

As shown in FIG. 8, certain exemplary embodiments comprise a rotatable aerial platform releasably coupleable to a telescopic boom forklift vehicle and constructed for elevating and positioning a load supporting deck. Rotatable aerial platform 1000 comprises an annular base member 1800 and yoke assembly 1900, which is constructed for positioning and adjusting rotatable aerial platform 1000. In the illustrated embodiment, a frame of rotatable aerial platform 1000 can be oriented such that when the frame is operably coupled to lift arms of a forklift or an articulated or telescopic boom, such as a telescopic forklift, the rotatable aerial platform can be positioned at a selected elevation relative to a chassis or other support structure of such vehicle. A proximal, lift arm-receiving end of the rotatable aerial platform is the end coupled to lifting arms of a forklift vehicle; and the distal end of the rotatable aerial platform 1000 is the cantilevered end of the platform such that the longitudinal axis of the platform lift arm receiving channels is aligned and parallel with a plane of forklift arms.

As illustrated in FIGS. 2-8, rotatable aerial platform 1000 comprises a rotatable framework for a load supporting deck 1600 for elevated work operations. As shown in FIGS. 6 and 8, rotatable aerial platform 1000 comprises an upper frame 1200, an annular base member 1800, which is fixedly coupled to (e.g., by welding) yoke assembly 1900 and coupled to the central pivot plate 1205 and bottom side surfaces of upper frame 1200, and forklift arm receiving channels 1920, 1940 are fixedly coupled (e.g., by welding) to a bottom ring 1820 of the annular base member 1800. Yoke assembly 1900 can comprise and/or be coupled to a pair of forklift arm receiving channels 1920, 1940, which channels are dimensioned to receive forks of a forklift. Annular base member 1800 is coupled to yoke assembly 1900. Load supporting deck 1600 is coupled to upper frame 1200. Load supporting deck 1600 is constructed to support personnel and materials. Rotatable aerial platform is rotatable and positionable about a vertical axis providing access to elevated locations.

As shown in FIGS. 2-5, upper frame 1200 comprises two opposed longitudinal side beams 1220, 1240, two opposed transverse end beams 1260, 1280, upper frame crosspiece beams 1290, 1290, 1290, 1290 and upper frame longitudinal pivot plate support beams 1292, 1292.

As shown in FIGS. 6 and 8, forklift arm receiving channels 1920, 1940 support bottom ring 1820 of annular base member 1800. In a preferred embodiment, forklift arm receiving channels 1920, 1940 comprise at least an upper plate 1945 and two opposed side plates 1950, 1955 designed to overlie fork arms while supporting annular base member 1800. In alternative embodiments, forklift arm receiving channels 1920, 1940 may be made by upper plate 1945, two opposed side plates 1950, 1955 and a lower plate 1960 designed to underlie the fork arms while the annular base member rests on the fork arms, such that the bounding walls of forklift arm receiving channels 1920, 1940 center and secure the annular base member 1800 on the fork arms. Plates defining forklift arm receiving channels 1920, 1940 are fixedly coupled together (e.g., via welding) and to a bottom surface of annular base member 1800. Forklift arm receiving channels 1920, 1940 are horizontally spaced and have a generally rectangular cross-sectional shape sized and dimensioned to thereby permit a lift arm to be slidingly received therein. As shown in FIGS. 6, 7 and 8, the side plates at their distal ends have aligned openings 1972, 1974 which accept locking fasteners 1971, 1973 respectively communicating through the aligned opening in the channels. Suitable examples of locking fasteners comprise cotter pins, split pins, set screws or other suitable locking device that can be securely fastened for locking the rotatable aerial platform to the forklift forks or arms. Forklift arm receiving channels 1920, 1940 have extending transversely between them spanning members 1274, 1274 to provide structural support thereto.

The annular base member 1800 can comprise an upper ring 1840, bottom ring 1820, a center hub 1850 and pivot plate 1860, plurality of radially spaced spokes 1880, an annular flange 1890 having an upper surface and a bottom surface. Center hub 1850 and pivot plate 1860 has a central aperture 1865 for receiving a pivot in the form of a pivot 1895 (e.g., a shaft or pin) that is rotatably received in central aperture 1865 defined in center hub 1850, which permits turning of upper frame on the annular base portion, as further described herein. Upper frame 1200 rotates about pivot 1895 relative to yoke assembly 1900. Upper surface of annular flange 1890 is constructed to engage with a plurality of rollers 1295 via which rotatable aerial platform 1000 rotates. Rotatable aerial platform 1000 rotates about center hub 1850. Radially spaced spokes 1880 are fixedly coupled to and provide support for center hub 1850 and pivot plate 1860.. Bottom ring 1820 of annular base member 1800 comprises a plurality of circumferentially spaced removable dogs 1898 threaded through the ring from its inner surface to and protruding beyond its outer surface for the purpose of resisting slippage of the chain around the circumference of bottom ring 1820. Bottom ring 1820 of annular base member 1800 comprises a plurality of circumferentially spaced protrusions 1899. Plurality of radially spaced protrusions 1899 are disposed on an outer surface of bottom ring 1820 of annular base member 1800 and serve as guides to align the chain upon the dogs.

Annular base member 1800 forms a wheel-like turntable, which is disposed horizontally, and which comprises annular flange 1890 horizontally extending from outer surface of annular base member 1800, as will be further described herein. A plurality of radially spaced spokes 1880, preferably four in number, are disposed within annular base member 1800 and fixed at their outer ends to the inner periphery thereof. At their inner ends, plurality of radially spaced spokes 1880 abut against and are secured in connection with center hub 1850, which center hub 1850 defines a central aperture 1865 therethrough.

Annular base member 1800 comprises an annular flange 1890 extending perpendicularly from outer circumferential surface thereof. A top surface of annular flange 1890 forms a raceway for plurality of rollers 1295 which are mounted on a bottom surface of the longitudinal side beams 1220, 1240 comprised by upper frame 1200. Annular base member 1800 comprises plurality of circumferentially spaced removable dogs 1898 threaded through a respective plurality of perforations through bottom ring 1820 and a plurality of circumferentially spaced protrusions 1899 which are disposed on the outer surface of bottom ring 1820 of annular base member 1800 to thereby guide the links of chain 1980 to align with dogs 1898. Plurality of rollers 1295, which can be coupled to upper frame 1200, are each in contact with annular base member 1800. Rotatable aerial platform rotates via plurality of rollers 1295.

A pivot plate 1205 having a generally circular shape is seated in upper frame 1200 and secured by welding to pivot plate support beams 1292 of upper frame 1200. Pivot plate support beams 1292 are fixed by welding at their outer ends to upper frame crosspiece beams 1290, 1290, 1290, 1290. Pivot plate 1205 overlies and is coterminous with center hub 1850 of annular base member 1800. Pivot plate 1205 comprises central pivot circular aperture 1215 axially aligned with central aperture 1865. A pivot 1895 extends downwardly through central pivot circular aperture 1215 in pivot plate 1205 and central aperture 1865 of center hub 1850, respectively. Pivot 1895 comprises a radial shoulder, which engages an upper surface of pivot plate 1205 seated in upper frame 1200. Pivot plate 1205, longitudinal pivot plate support beams 1292 and upper frame crosspiece beams 1290, 1290, 1290, 1290 surrounds and is rotatable about pivot 1895. Upper frame longitudinal side beams 1220, 1240 carry mounted on their bottom sides a plurality of rollers 1295 which rest on a flat top surface of annular flange 1890 of annular base member 1800 and on which in turn rests the upper frame 1200 and load supporting deck 1600 which is centered by the pivot 1895. Plurality of rollers 1295 may be hardened steel rollers or any suitable material for providing an antifriction bearing for the upper frame 1200. One having ordinary skill in the art will understand that the term "pivot" is used in a functional sense indicating a generally cylindrical structural member that couples an axle or center of a wheel or gear that allows or causes it to turn or rotate. Examples pivots comprise pins, shafts, kingbolts, rods, and/or bars, etc. Those of skill in the art will understand that any suitable connecting member can be used in forming a pivot.

As shown in FIGS. 4, 5, 6 and 8, a power transmission system conveys power to annular base member 1800 through chain 1980 driven by electric or hydraulic motor or drill-driven shaft fixedly coupled to upper frame 1200 thereby causing upper frame 1200 and load supporting deck 1600 to rotate on plurality of rollers 1295 thereby providing antifriction roller bearings as upper frame 1200 overlies annular base member 1800. Plurality of rollers 1295 are mounted on bottom side surface of upper frame longitudinal side beams 1220, 1240 such that the plurality of rollers 1295 rest on or travel circumferentially on the upper surface of annular flange 1890 at locations therealong corresponding to raceway provided on the upper surface of annular flange 1890, as further described herein. In certain exemplary embodiments, the power transmission system is a chain drive system. Examples of suitable alternative embodiments of mechanical power transmission systems comprise gear drives, belt drives, or manual crank drives. One having ordinary skill in the art would be able to select a suitable drive system for transmitting power from one component to another such as e.g. between the drive and the rollers for any particular rotatable aerial platform embodiment while meeting requirements for size and space, weight, load, speed and torque, cost, maintenance and service conditions, noise, vibration, or harsh environmental conditions. Chain drive system sprocket 1038 is provided with shaft import power supplied by a reversible motorized device 1036. In a preferred embodiment, the motorized device 1036 is a reversible electrical motor powered by a power source 1087 such as a portable power station jump starter with detachable connectors such as jumper cables, as will be further described herein. In alternative embodiments, the chain drive may be powered by connecting to the forklift vehicle's electric power system. As shown in FIG. 7, the reversible motorized device 1036 is supported by upper frame 1200 proximal to annular base member 1800 for rotating the upper frame 1200 with its inset load supporting deck 1600. Chain 1980 remains fixed in its position proximal to annular base member 1800 coupled by removable dogs 1898 upon which links of chain 1980 are aligned by circumferentially spaced protrusions 1899. Motor-driven or otherwise powered sprocket 1038 engages with and moves along chain 1980 to cause upper frame 1200 and load supporting deck 1600 to rotate about center hub 1850 and central aperture 1865 on pivot 1895 as rotatably coupled thereby to annular base member 1800 of yoke assembly 1900. Idler/tensioner sprockets 1040, 1042 provide spring-loaded tension to chain 1980, which encircles and engages annular base member 1800 at a location below annular flange 1890 and above the plurality of circumferentially spaced protrusions 1899 to thereby resist the chain from shifting downwardly. The chain drive comprises chain 1980 and a plurality of sprockets (e.g., sprocket 1038 and idler/tensioner sprockets 1040, 1042). Each of the plurality of sprockets are engaged by chain 1980. The chain drive is constructed to cause upper frame 1200 to rotate relative to yoke assembly 1900. A motor of motorized device 1036 can cause the chain drive to rotate the upper frame 1200 relative to yoke assembly 1900. The chain drive can comprise an electrical motor. The electrical motor can be constructed to cause movement of the chain drive.

The load supporting deck 1600 is secured to the upper frame 1200. Load supporting deck 1600 comprises two opposed side edges and two opposed end edges. As shown in FIGS. 2, 3, 4 and 5, the load supporting deck 1600 is bounded by guard rails on all sides including longitudinally extending side guard rails 1682 and transversely extending end guard rails 1684 to provide fall restraint, and locations for anchoring personal fall protection systems; and for protection of personnel to thereby minimize the risk of workers or materials falling from the load supporting deck 1600.

The upper frame 1200 further comprises an upstanding flange along outer edge bounding the load supporting deck 1600. Load supporting deck 1600 can comprise a slip resistant surface for protection of personnel against slipping or skidding thereupon.

As shown in FIGS. 2, 3, 4, 5 and 7, a power source 1087 is secured to upper frame 1200 of rotatable aerial platform 1000 at a location adjacent to control pedestal 1086 outside guardrails 1082,1084. In a preferred embodiment depicted in FIGS. 4-5 and 7, the control pedestal 1086 is secured to rotatable aerial platform 1000 at a proximal end in a position where it will not interfere with the forklift arms when received within forklift arm receiving channels 1920, 1940. for accommodating the motorized device 1036. Control pedestal 1086 can be fixedly coupled to outer surface of upper frame 1200 with a motor housing structure mounted therein. Control pedestal 1086 can comprise one or more switches that cause upper frame 1200 to rotate relative to yoke assembly 1900.

Materials suitable for fabrication of the upper frame 1200, annular base member 1800, and yoke assembly 1900 can comprise steel, aluminum, metal alloys, and/or any durable, sturdy materials having suitable properties.

Forklift vehicles are commonly made with provisions for adjustment of the fork arms toward and from each other, and the arm receiving channels are located at a distance apart which is within the range of such adjustment and they are also located as near as possible to the outside edges of the annular base member to afford stability without undue material strain. The form lift arm receiving channels are made with dimensions closely approximating the cross section of the forklift arms, with sufficient clearance to permit easy entrance and withdrawal of the forklift arms. Yoke assembly 1900 is coupled to upper frame 1200 clear of the fork; and the sprocket drive and motor are mounted in a position where it will not interfere with the fork arms when entered into the forklift arm receiving channels. When not in use, the annular base and arm receiving channels rest on or may be supported from the floor on blocks or any other convenient standard with the arm receiving channels at a height between the limits of upward and downward travel of the fork. It may then be mounted on the fork by advancing the telehandler or forklift vehicle such that the fork arms are entered into and received within the arm receiving channels and by raising the vehicle elevator or telescopic boom lift arms. Conversely, the aerial platform is disengaged from the fork lift vehicle by the action of lowering the raised elevator, boom or lift arms until the channels underlying the annular base member rests on the ground surface or on its supporting blocks or standard, and backing off the vehicle or telehandler.

When rotatable aerial platform 1000 is thus coupled to lift arms of a forklift vehicle or the telescopic boom of a telehandler class vehicle, the motor is coupled with the chain drive system.

Alternative motors: a hydraulic motor coupled to drive sprocket 1038 and powered by hydraulic accessory systems, which are part of the fork lift or other lifting vehicle; or a drive shaft coupled to drive sprocket 1038 and mounted to the control pedestal 1086 in such a way as to allow the coupling of either of a manual crank or a forward and reversing drill.;

Via rotatable aerial platform 1000, personnel and materials can be carried by a forklift telehandler vehicle and elevated and positioned in a location proximate to or flush with a vertical wall, roof, or interior corner, as well as in other locations which could not be reached owing to limited maneuverability of forklift type vehicles.

Definitions

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.
access—an ability to approach.
activity—an action, act, step, and/or process or portion thereof.
adapted to—made suitable or fit for a specific use or situation.
adapter—a device used to effect operative compatibility between different parts of one or more pieces of an apparatus or system.
aerial—above a surface, the surface defining a base elevation.
and/or—either in conjunction with or in alternative to.
annular—shaped like a ring.
annular flange—an upper or outer edge of an annular object.
apparatus—an appliance or device for a particular purpose.
assembly—a set of components.
associate—to join, connect together, and/or relate.
base—a supporting portion of something.
can—is capable of, in at least some embodiments.
cause—to produce an effect.
central—a portion of something that is between two other portions.
chain—a series of metal links coupled one to another and used for transmission of mechanical power.
chain drive—a system comprising sprockets coupled by a series of metal links coupled one to another, the system constructed for transmission of mechanical power.
channel—a member having a cross section with a base and two upturned sides, wherein each of the two upturned sides join the base at substantially right angles.
circuit—an electrically conductive pathway and/or a communications connection established across two or more switching devices comprised by a network and between corresponding end systems connected to, but not comprised by the network.
circumferentially—in a way that encircles; around the circumference.
comprising—including but not limited to.
configure—to make suitable or fit for a specific use or situation.
connect—to join or fasten together.
constructed to—made suitable or fit for a specific use or situation.
contact—to touch.
control—a switch or adjustment that directs one or more activities.
control pedestal—a base or support on which an control is mounted
convert—to transform, adapt, and/or change.
coupleable—capable of being joined, connected, and/or linked together.
coupling—linking in some fashion.
crank—a mechanical device that is rotated by a user and transmits motion.
create—to bring into being.
define—to establish the outline, form, or structure of.
determine—to obtain, calculate, decide, deduce, and/or ascertain.
device—a machine, manufacture, and/or collection thereof.
dimensioned—sized.
disposed—something set in a particular place.
downwardly—in a direction of lowest elevation for an uprightly oriented system.
electric motor—an electrical machine that converts electrical energy into rotational mechanical energy.
elevated—positioned at a height above a base surface.
engage—to be in contact and interact with.
estimate—to calculate and/or determine approximately and/or tentatively.
flexure—an action of bending.
fork—an implement comprising two prongs.
forklift—a vehicle with a pronged device in front, which vehicle is constructed for lifting and carrying heavy loads.
frame—a supporting structure.
generate—to create, produce, give rise to, and/or bring into existence.
handrail—a bar sized to be grasped by a hand of a human that serves to restrain motion of the human relative to a location in proximity to the handrail.
hub—a point in a system at which components are coupled.
initialize—to prepare something for use and/or some future event.
install—to connect or set in position and prepare for use.
limit—to restrict something.
location—a place substantially approximating where something physically exists.
manual—operated by a human hand.
material—substances utilized for a particular purpose.
may—is allowed and/or permitted to, in at least some embodiments.
member—a structural unit.
method—a process, procedure, and/or collection of related activities for accomplishing something.
motor—an electric, hydraulic, and/or pneumatic device that produces or imparts motion.
outer—situated so as to be furthest away from a center of a system.
pair—two similar things used together.
personnel—one or more persons.
pivot—a component around which something rotates.
platform—a structure comprising a substantially horizontal surface that can be raised above a level of a surrounding area.
plurality—the state of being plural and/or more than one.
position—a location occupied by a physical object.
predetermined—established in advance.
probability—a quantitative representation of a likelihood of an occurrence.
project—to calculate, estimate, or predict.
protrusion—a part that extends beyond or above a surface.
provide—to furnish, supply, give, and/or make available.

radially spaced—located at spaced positions around a circumference of a circle.
receive—to get, take, acquire, and/or obtain.
relative to—in comparison with.
repeatedly—again and again; repetitively.
request—to express a desire for and/or ask for.
roller—a revolving cylinder on which something is moved.
rotate—to move or cause to move around an axis or center.
select—to make a choice or selection from alternatives.
set—a related plurality.
slip resistant—having a surface that resists a tendency of a shoe worn by a human to slide along the surface.
spaced—set apart by a predetermined distance.
sprocket—a toothed wheel.
spoke—a bar coupling a center of an annular component to the annular component's outer edge.
store—to place, hold, and/or retain.
substantially—to a great extent or degree.
support—to bear the weight of, especially from below.
surface—the outer boundary of an object or a material layer.
switch—a mechanical, electrical, and/or electronic device that opens and/or closes circuits, completes and/or breaks an electrical path, and/or selects paths and/or circuits.
system—a collection of mechanisms, devices, machines, articles of manufacture, processes, data, and/or instructions, the collection designed to perform one or more specific functions.
telehandler—also called a telescopic handler, teleporter, reach forklift, or zoom boom; is a machine used elevated work applications. A telehandler is somewhat like a forklift but has a boom (telescopic cylinder), making it more a crane than a forklift, with versatility from a single telescopic that can extend forwards and upwards from the vehicle. The boom is fitted with a platform.
transmit—to send, provide, furnish, and/or supply.
upper—above when a device is uprightly oriented.
vertical axis—an imaginary line that is substantially perpendicular to a horizontal plane.
via—by way of and/or utilizing.
weight—a value indicative of importance.
yoke—a frame constructed to couple a vehicle to a platform.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;
no characteristic, function, activity, or element is "essential";
any elements can be integrated, segregated, and/or duplicated;
any activity can be repeated, any activity can be performed by multiple entities, and/or any activity can be performed in multiple jurisdictions; and
any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A system comprising:

a rotatable aerial platform comprising:
a yoke assembly, the yoke assembly comprising a pair of forklift arm receiving channels dimensioned to receive forks of a forklift;
an annular base member, the annular base member coupled to the yoke assembly, the annular base member comprising,
an upper surface, the upper surface constructed to engage with a plurality of rollers via which the rotatable aerial platform rotates;
a central hub about which the rotatable aerial platform rotates;
a plurality of radially spaced spokes, which limit flexure of the annular base member; and
an annular flange, the annular flange comprising plurality of radially spaced protrusions, the plurality of radially spaced protrusions disposed on an outer surface of the annular base member to thereby resist a chain from shifting downwardly;
an upper frame;

a chain drive, the chain drive comprising the chain, the chain drive constructed to cause the upper frame to rotate relative to the yoke assembly;

a load supporting deck coupled to the upper frame, the load supporting deck constructed to support personnel and materials; and wherein the rotatable aerial platform is rotatable and positionable about a vertical axis providing access to elevated locations.

2. The system of claim 1, further comprising:

the forklift.

3. The system of claim 1, further comprising:

a motor that causes the chain drive to rotate the upper frame relative to the yoke assembly.

4. The system of claim 1, further comprising:

a control pedestal, the control pedestal comprising one or more switches that cause the upper frame to rotate relative to the yoke assembly.

5. The system of claim 1, further comprising:

a plurality of rollers, each of the plurality of rollers in contact with the annular base member, wherein the rotatable aerial platform rotates via the plurality of rollers.

6. The system of claim 1, further comprising:

a plurality of rollers, the plurality of rollers coupled to the upper frame, the plurality of rollers in contact with the annular base member, wherein the rotatable aerial platform rotates via the plurality of rollers.

7. The system of claim 1, further comprising:

a pivot about which the upper frame rotates relative to the yoke assembly.

8. The system of claim 1, wherein:

the chain drive comprises a plurality of sprockets, each of the plurality of sprockets engaged with the chain.

9. The system of claim 1, wherein:

the chain drive comprises an electrical motor, the electrical motor constructed to cause movement of the chain drive.

10. The system of claim 1, wherein:

the load supporting deck comprises a set of handrails.

11. The system of claim 1, wherein:

the load supporting deck comprises a slip resistant surface.

12. The system of claim 1, wherein:

the rotatable aerial platform is rotated via a manual crank.

* * * * *